United States Patent [19]

Cox et al.

[11] 4,293,936

[45] Oct. 6, 1981

[54] TELEMETRY SYSTEM

[75] Inventors: William H. Cox, Groves; Preston E. Chaney, Dallas, both of Tex.

[73] Assignee: Sperry-Sun, Inc., Sugar Land, Tex.

[21] Appl. No.: 968,879

[22] Filed: Dec. 13, 1978

Related U.S. Application Data

[63] Continuation-in-part of Ser. No. 755,620, Dec. 30, 1976, abandoned.

[51] Int. Cl.[3] ..... G01V 1/40

[52] U.S. Cl. ..... 367/82; 166/73; 73/579

[58] Field of Search ..... 367/82; 166/73; 73/579; 33/304–307

[56] References Cited

U.S. PATENT DOCUMENTS

| | | | |
|---|---|---|---|
| 3,190,388 | 6/1965 | Moser et al. | 367/82 |
| 3,252,225 | 5/1966 | Hixson | 33/307 |
| 3,697,940 | 10/1972 | Berka | 367/82 |
| 3,845,837 | 11/1974 | McEuevers, Jr. et al. | 367/82 |
| 3,889,228 | 6/1975 | Shawhan | 367/82 |
| 3,930,220 | 12/1975 | Shawhan | 367/82 |
| 4,001,773 | 1/1977 | Lamel et al. | 367/82 |
| 4,073,341 | 2/1978 | Parker | 367/82 |

OTHER PUBLICATIONS

Barnes et al., "Passband for Acoustic Transmission . . . String," 1972, pp.1606–1608, Jour. of the Acoust. Soc. Amer., vol. 51, #5.

*Primary Examiner*—Nelson Moskowitz
*Attorney, Agent, or Firm*—M. Lee Murrah

[57] ABSTRACT

A telemetry system for transmitting data between a downhole location in a wellbore and the surface of a well utilizing an acoustic signal which operates within naturally occurring passbands on a string of pipe have substantially fixed frequency ranges which are related to pipe length and condition.

33 Claims, 10 Drawing Figures

TELEMETRY SYSTEM

CROSS REFERENCE TO RELATED APPLICATION

This application is a continuation-in-part of applicant's co-pending application Ser. No. 755,620, filed Dec. 30, 1976 now abandoned.

BACKGROUND OF THE INVENTION

This invention relates to a drill stem telemetry system, and, more particularly, to a means for transmitting data through a drill stem from the bottom of a wellbore to the surface, and vice-versa, utilizing acoustic telemetry. The need for means of transmitting downhole data to the surface during the process of a drilling operation has been recognized in the oil industry since the inception of modern drilling techniques. However, in recent years with the advent of deeper drilling operations and technical innovations which permit the detection of downhole parameters useful at the surface during a drilling operation, the need for such a telemetry system has increased, and as a result, the effort expended by the oil industry toward developing such systems has increased proportionately. An example of this need occurs when the driller needs a form of communicating from downhole to the surface, information as to the type of formation which is being drilled. Since the optimum combination of rotary speed and weight on a drill bit changes significantly with the type of formation being drilled (sand, shale, limestone, chert, etc.) a driller is unable to optimize the penetration rate without this corresponding information. Attempts have been made to develop logging while drilling systems, one such device being set forth in U.S. Pat. No. 2,755,431, but at present no system has found widespread acceptance in the industry for various reasons. Some systems have utilized cables for transmitting information from downhole to the surface but require complete withdrawal of the cable or making of connections in the cable at the surface each time a section of pipe is added. This is a cumbersome and time consuming operation and has not received acceptance. Attempts have been made to develop electrical conducting paths within a string of pipe by the use of pipe couplings which incorporate electrical conductors. Again such systems have not been developed in this country to an acceptable commercial use level. Even though the technical feasibility of such a system has been demonstrated, it requires a special drill string at greatly increased cost.

Hole deviation from the vertical and in what direction such deviation takes place is another parameter of importance in drilling operation. Such directional survey information is most important on wells which are intentionally deviated, in order to drain reservoir locations which are inaccessible or extremely costly to reach by vertical drilling. An early example of this type of drilling is the Huntington Beach and Ventura fields in California. These fields are located on the Pacific shoreline, with most of the area of the reservoir beneath the ocean. In the 30's and early 40's when these fields were drilled, it was necessary to devise the techniques and to develop tools for controlling directional drilling so that land based rigs could tap the oil beneath the ocean. The directional drilling process, then as well as now, was made more complex and expensive because of the lack of any means for telemetering this data from the bottom of the hole to the surface. As a result, such data was taken by photographic or chemical means onto instruments which were retrieved to the surface either through pulling the pipe or locating such instruments at the end of a wire line or cable which would be retrieved from the wellbore by discontinuing the drilling operation. This, of course, is a costly and time consuming operation which is aggravated in modern drilling times because of the sometimes extreme depth of wells which necessarily involves a long time factor when retrieving data by means of a wire line. Also, the high expense of operating drilling rigs, particularly in hostile environments such as offshore areas where rig time is extremely expensive becomes a very important factor since the cessation of drilling is necessary in order to retrieve data.

During the 40's, a number of companies recognized the economic potential of a telemetry system and initiated research to develop one. Most of this work was carried on by these companies independently but, invariably, after studying many of the possible transmission methods, they arrived at the same conclusion that sound transmission through the metal of the drill pipe was the most promising. Electromagnetic (radio) transmission was considered a poor second because of rapid attenuation of such signals in the formations of the earth. Since the rate of attenuation of sound in steel was known to be quite low, it was logical to assume that sound signal transmission through the metal wall of the drill pipe would be relatively simple. However, this turned out to be far from the case. In 1948 Sun Oil Co. built a system for testing the feasibility of drill pipe acoustic telemetry, which consisted of a downhole impulse sound source and a surface package designed to receive transmitted sound and measure its amplitude in each of three frequency bands. The sound source contained a battery powered motor which wound up a spring. When fully wound, the spring was released and drove a weight to deliver a sharp hammer blow to the end of the drill pipe. The receiving equipment consisted of a accelerometer attached to the drill pipe having its output connected to an amplifier which in turn fed three band pass filters for separating the energy spectrum into low, medium, and high frequency bands. The results of this feasibility study were very disappointing. The attenuation rate varied somewhat between the three bands, but was so high even in the best range as to discourage any further efforts along this line. Sun Oil concluded that acoustic telemetry was not feasible within the state of the art existing in 1948. This telemetry research project was dropped and was not reinstated until about 1969 when it was considered practical to use repeaters to overcome the high attenuation rate.

Another company doing research at that time was in the principle business of gun perforation of casing. Perforating casing is an essential step in completing oil and gas wells in which the well was drilled and cased through the producing sand as opposed to the earlier and less satisfactory practice of setting the casing just above the producing sand and drilling in for an open hole completion. This company became interested in radio active (gamma ray) logging as a means of logging cased holes, first in order to control their perforating guns more precisely, but also as a means of locating other potential producing zones behind the casing. This company established a well logging research laboratory around 1948 and one of the major projects was that of downhole telemetry. Their research program began in a very similar way to that of Sun's. After examining the alternatives, they selected drill pipe acoustic telemetry as the most promising course and set out as did Sun to measure the acoustic attenuation rate of drill pipe. The final tests in this program were convincing that drill stem acoustic telemetry was not possible. This latter test was conducted as follows: the downhole sound source consisted of a set of jars which were arranged to drop a section of drill collar about 3 feet each time the jars were actuated. On the surface, a geophone was used as the detector and was probably fed into a seismic amplifier and recorder system. The attenuation rate measured by this method was so high as to convince the experimenters that sound transmission through the drill pipe was impractical. They felt it necessary to switch their efforts to a mud pulse transmission method and to accept the greatly reduced rate of data transmission which was implied by a mud pulse system. The company continued work on the mud pulse telemetry system until the technology was sold to another party which attempted to market the system as a means of logging while drilling. In any event, the conclusion of this company, that mud pulse telemetry was the only way to go, apparently influenced much of the subsequent telemetry research so that much of the research currently taking place in the field of drill stem telemetry is centered about a technique known as mud pulse telemetry. The mud pulse system involves much more complex hardware and a slower data rate over the potentially cheaper and faster acoustic drill pipe system.

Sun Oil Co. resumed research on drill pipe acoustic telemetry in 1968, fully aware that attenuation rates would be high, but hoping to overcome this difficulty by using a number of repeater stations. Based on the attenuation measurements made in 1948, of about 12 decibels per thousand feet, it appeared feasible to use a system of repeaters spaced along the drill pipe, each receiving data from the station below at one frequency and re-transmitting at another frequency to the next station above. A transmitter and repeater system was built up to operate in this manner. In order to achieve maximum discrimination against noise, the transmission was digital and used either a single crystal controlled frequency which was turned on for one and off for zero, or in some cases a pair of closely spaced frequencies with one frequency representing a one and the other frequency a zero. Thus, the new system differed from the 1948 experiment only in that discreet frequencies were used rather than a broad band source such as the weight and spring. In order to use the multiple repeater system, three transmission frequencies were needed for the on-off logic or six for the two frequency logic. Therefore, an arbitrary selection was made. For the two frequency logic system the following pairs of frequencies were selected: 860–880 Hertz (Hz); 1060–1080 Hz, and 1260–1280 Hz. All of these frequencies were within a band for which the 1948 test indicated the attenuation rate should be in the 10–12 decibels per thousand feet range. The first field test was run using the 860–880 Hz band. This test confirmed the 10–12 decibel per thousand feet anticipated as an attenuation rate and indicated the feasibility of the repeater system as planned.

However, when it was attempted to transmit in the 1060 to 1080 Hz band, attenuation was found to be so great that no satisfactory data could be received in order to measure the exact attenuation rate. In a period of a little over a year from these first tests, a number of other frequencies were tried, but none was found to equal the 860 Hz band. It is to be remembered that there was no basis for selecting one frequency over any other, the choice being entirely random. Furthermore, it was found that the attenuation rate at the 860 Hz varied greatly from one test to another. It appeared to be dependent on the condition of the drill pipe, but in a way that was not understood. On drill pipe that was new, or in very good condition, the attenuation rate at 860 Hz was in the 10–12 decibel per thousand foot range while on badly worn drill pipe, the attenuation rate was often 30 decibels or more per thousand feet. In a search for an explanation of these results, a technical publication was studied entitled "PASSBANDS FOR ACOUSTIC TRANSMISSION IN AN IDEALIZED DRILL STRING" by Barnes and Kirkwood, published in the Journal of Acoustical Society of America, Volume 51, No. 5, (1972), pages 1606–1608. This article described a theoretical analysis of the drill pipe string as an acoustic filter and indicated that there should be a number of relatively narrow passbands separated by wider rejection bands in which no sound transmission could occur. This publication seemed to offer some explanation for the strange results of the Sun Oil tests. However, it was disappointing to find that the most successful frequency in the Sun test, i.e. 860 Hz, fell squarely in one of the rejection bands of the Barnes Kirkwood paper. Also, other frequencies that had been tried by Sun, for example 760 Hz, should have been in good transmission passbands which was contrary to the experimental data. Consequently, interest was lost in the Barnes and Kirkwood theoretical analysis and a resumption of the random choice attempts to find the three transmission bands was revived. However, this random choice technique was turning out to be a very expensive, frustrating and time consuming process.

It is readily seen from the background information above that prior attempts at acoustical telemetry in a drill pipe have met with difficulties. Therefore, it is an object of the present invention to provide an acoustic transmission system for use in a borehole, which system utilizes natural passbands within an elongated pipe string, and selecting acoustic frequencies which are adaptable to such passbands and the environment of a wellbore and more particularly the environment of a drilling operation.

SUMMARY OF THE INVENTION

With these and other objects in view, the present invention contemplates an acoustical transmission system for use in pipe suspended in a wellbore wherein an acoustical signal is introduced into a pipe, transmitted through the pipe and received at another spaced position along the pipe, such signal moving in the pipe at a frequency falling within a passband of the pipe string and adapted to conform to other selective parameters of a borehole environment. The acoustical signal is arranged so that it may be coded or modulated in such a way as to transmit information from one position to another along the pipe.

DESCRIPTION OF THE PREFERRED EMBODIMENTS

Figure 2:
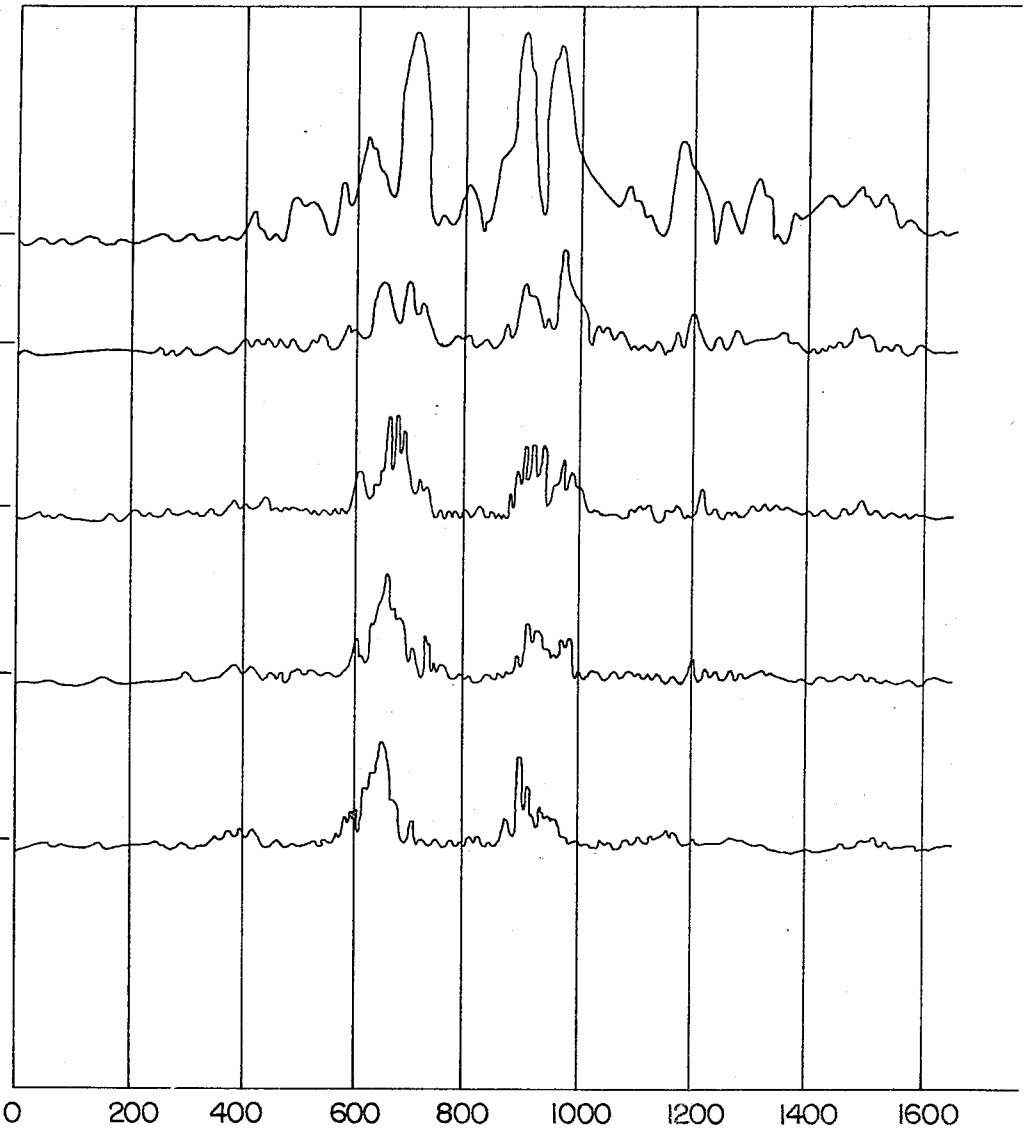
FIG. 2 is a graphic representation of observed test data from the procedure shown in FIG. 1.

Theoretical data set forth in the paper entitled "Passbands for Acoustic Transmission In An Idealized Drill String" by Barnes and Kirkwood describes a theoretical analysis of a drill pipe string as an acoustic filter and indicates that the pipe string exhibits a number of relatively narrow passbands separated by wider rejection bands in which no sound transmission can occur. In the evolution of circumstances leading to the present invention it was found that the theoretical data from the above paper did not correlate with data obtained from actual tests and therefore it was decided to conduct additional tests to find the ever elusive solution to the problem of acoustic transmission in a drill string.

It was considered that if drill pipe was to act as a tuned transmission line, capable of passing certain frequencies and rejecting others, this property could be measured in a transient test analysis as is done for electrical transmission lines. An impulse test was designed to introduce a sharp sound pulse of short duration into one end of a drill stem suspended vertically in a borehole. This test set up is shown schematically in FIG. 1 where the upper end of a pipe string 11 is fitted with the pin end 13 of a tool joint having a plate 15 welded to its upper end to provide a sound coupling into the string of pipe as will be described later. The lower end of the pipe string was similarly fitted with the box end 17 of a tool joint having a plate 19 at its lower end. A chamber formed from a section of pipe 21 is attached to the plate. A threaded cap 23 having an O ring seal 25 is attached to the lower end of the chamber. A conventional crystal accelerometer 27 is mounted directly to the plate 19 and extends downwardly into and is housed within the chamber 21. A preamplifier 29 is connected with the output of the crystal 27 to match the low level output of the crystal to the relatively low impedence input of a cassette tape recorder 31 also located in the chamber 21. A cassette tape having a playing time of 60 minutes on one side was used in the recorder. The recorder was turned on at the surface and run into the wellbore on the pipe thus limiting the total duration of test time from that point to 60 minutes. After initially making up 313 feet of pipe in the hole, the first sound transmission test was made. The sound impulse was provided by sharply striking a ball peen hammer 33 against the plate 15 at the upper end of the test string in the following manner. One pulse was made, then several seconds elapsed before a series of 10 pulses spaced by one second were imparted to the plate. The ball peen hammer, when struck sharply and allowed to bounce, produces a sharp pulse (less than one millisecond) and a relatively high level of energy. After the first series of pulses, additional sections of pipe were added to the string to place the recorder at 527 ft., and after an initial two pulse code to signify a second test, the 10 pulse count was repeated. This procedure was repeated at 919 ft., 1253 ft. and 1566 ft, whereupon lapsed time on the tape cassette would not permit additional data to be taken. It is pointed out that the impulse test provides a pulse having energy up to a maximum frequency determined by the sharpness or duration of the pulse. For example, if the hammer pulse is one millisecond in duration, the pulse will contain energy having all frequencies from D.C. up to 1000 Hz. The ball peen hammer technique in these tests provided frequencies above 1000 Hz.

Now that pulse data was recorded downhole, the recorder was retrieved by pulling the pipe. However, once the raw data was recorded on tape the problem of data analysis had just begun. The sound signal recorded on the cassette tape was, in what acoustic engineers refer to as the "time domain", i.e. the tape recorded signal was a continuous record of the amplitude versus time.

In order to analyze the frequency spectrum of the recording, it was necessary to convert the record to the frequency domain by a mathematical process known as a Fourier Transform. This is a process far too complex to be done by hand calculations, and from a practical standpoint requires the use of high speed digital computers. Therefore, it was necessary to convert the "time domain" data to digital form for entry into a computer.

Seismic data processing facilities frequently utilize the Fourier Transform technique. Therefore, many geophysical data processing centers have equipment for digitizing and analyzing seismic records. However, there is a problem in the use of such equipment to analyze the acoustical data of the present situation in that seismic records characteristically contain frequencies only in the range of zero to 100 Hz with little or no useful data above 100 Hz. In digitizing any type of data there is a requirement that the time increment between points of digitization must be short enough to provide at least two points per complete cycle at the highest frequency contained in the record. Otherwise, errors are introduced which cannot be corrected by later processing. Geophysical data is typically digitized every 2 milliseconds. If any frequency has a cycle which is completed in less than two digitizing intervals, then you get less than two points on a frequency cycle and this will not adequately describe the wave shape. This go-no go frequency level is called Nyquist frequency and is at 500 Hz in geophysical data processing equipment. Therefore, in order to minimize the number of digital values which it is required to record and to eliminate any chance of exceeding the Nyquist frequency, all seismic digitizing equipment passes the input data through a very sharp low pass filter designed to essentially eliminate all frequencies above about 250 Hz before digitization. Since in the present application it was wished to study possible bassbands as high as 2500 Hz, this frequency filtering limitation was prohibitive.

There was no other known source of digitizing equipment and the cost of building a special digitizer for this application was prohibitive. It was discovered that the recordings made of the sound pulses in the present situation could be scaled down into the seismic frequency range by re-recording the pulses at a tape speed of $7\frac{1}{2}$ inches per second after which this tape could be played at $1\frac{7}{8}$ inches per second and recorded again on the cassette tape. By this procedure all the frequencies on the first tape were reduced by a factor of 4. But this was still not enough to bring the 2500 Hz band below the 250 Hz seismic digitizing limit. Therefore, the sound cassette record was again recorded at a speed of $7\frac{1}{2}$ inches per second and played back onto cassette tape at both $3\frac{3}{4}$ per inches per second and $1\frac{7}{8}$ inches per second to get two sets of records with overall frequency divisions of 8 to 1 and 16 to 1 respectively. It was necessary to digitize and process at both of these latter tape speeds because the 16 to 1 frequency division caused the lower frequencies of interest (below 500 Hz) to fall below the low frequency response of tape recorders (approximately 30 Hz). On the other hand, the 8 to 1 reduction was not sufficient to bring the 2500 Hz region into the passband of the seismic digitizer.

With this unorthodox procedure, it was possible to get the impulse test data shifted into the seismic frequency range and digitized so that it could be transformed into the frequency domain and analyzed by conventional seismic data processing techniques, provided that the appropriate frequency multiplier was applied to the processed data to compensate for the slow down process. This lengthy process was applied to the series of impulse test recordings made during the tests set forth above.

Referring next to FIG. 2, the computer output of this analytical process was printed out in the form of a spectral energy density versus frequency curve for each of the five depths. The results of this analytical process are most interesting. Even at the shallowest depth of 313 feet, there was clear evidence of preferred frequency passbands as evidenced by the peaks on the curves in FIG. 2. As more pipe was added to the string, up to the maximum of 1566 feet, these passbands became sharper and the transmission outside these bands fell very nearly to zero.

Figure 3:
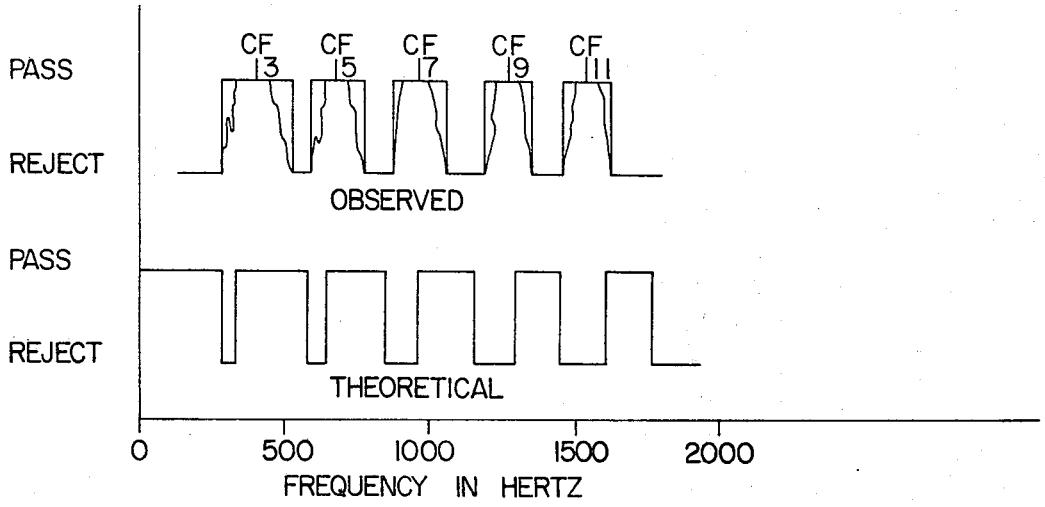
FIGS. 3 and 4 are graphic representations of acoustic passbands derived from observed test results as compared to theoretical data.

Barnes and Kirkwood were qualitatively right in predicting that drill pipe behaves as a mechanical filter, passing certain bands of frequency and rejecting others. FIG. 3 shows a comparison of the Chaney and Cox observed data with Barnes and Kirkwood theoretical data for 31 ft. drill pipe. In comparing the theoretical band pass frequencies with measured data from the impulse test as shown in FIG. 3, it was found that the band locations of the Barnes and Kirkwood paper were almost totally out of phase with the measured data. This is true particularly in the frequency range from about 600 Hz to 1500 Hz, which is the preferred range for acoustic telemetry, where there is almost total disagreement between the Barnes and Kirkwood prediction and the measured data. In this respect it turns out that in the range of 480 Hz to 1740 Hz, all of the reject bands in the measured data lie completely within passbands as predicted by Barnes and Kirkwood. Similarly, reject bands predicted by Barnes and Kirkwood are almost totally within the passbands observed in actual drill pipe tests. Since the passbands in each case are wider than the adjacent reject bands, there is of necessity some overlap in the observed and theoretical passbands. This is obviously coincidental in view of the total disagreement between observed and calculated reject bands.

As might be expected, the boundaries between pass and reject bands were not as sharply defined in the test data as in the Barnes and Kirkwood theoretical treatment. This was most evident in that considerable attenuation occurred in the edges of each passband. While only five passbands were clearly identified in the observed data, there is a pattern in the location thereof which indicates that others exist. For example, the lowest frequency of each passband is closely approximated by the multiples of a frequency computed by the formula 17450/(2×pipe joint length) where 17450 represents the velocity of sound in drill pipe in feet per second. Thus, this fundamental frequency is such that one length of drill pipe is a half wave length at that frequency. The average joint length of the drill pipe used in the test was 30.8 feet, excluding the thread. Thus the above formula yields a basic frequency of 17,450/(2×30.8)=283 Hz. It will be observed that the lower frequency ends of the five passbands observed in the experiments fall very nearly to 1, 2, 3, 4 and 5 times this frequency.

In view of this re-occurring pattern it is evident that a lower transmission band with a starting frequency of zero×283 Hz must also exist. This band must extend to 0 Hz, because it is obvious that the drill pipe transmits "DC" displacements without attenuation. This "fundamental" passband was lost in the analytical procedure as a result of dividing the frequency by 8 or 16 as explained earlier. Even a division by 8 would place the appropriate center frequency of this lowest passband at 17 Hz which is far below the low frequency response capability of the cassette tape recorder used for this procedure. It would also be expected that transmission bands would occur at higher multiples than 5 times the basic frequency. These transmission bands would be weaker because the natural attenuation increases with increasing frequency.

In a separate experiment satisfactory transmission was observed to a depth of 700 feet using a frequency of 2304 Hz which lies in the passband with a lowest frequency of 2264 Hz corresponding to the 8th multiple of 283 Hz.

The width of the transmission bands is somewhat inexact because of the gradual decay rather than a sharp boundary which exists in the definition of the passbands. In each case the preferred operating range is in a 150 Hz band beginning at a base which is a 20 Hz above the starting frequency of each passband as calculated by a formula above. The 20 Hz gap moves the base of the band past the slope found at the edges of the passbands, it being understood that telemetry might be practical in this gap but less attenuation takes place in the 150 Hz band above this gap. Due to less attenuation at lower frequency, the lower frequency passbands are somewhat broader and therefore some transmission would be expected beyond plus or minus 100 Hz from the center frequency, while passbands above 2000 Hz might be narrower.

It should be noted that the location of the starting frequency of each passband is not fixed but rather is a function of the length of the individual joints of drill pipe. The starting frequency locations which are listed above are correct for the most common length of drill pipe used by the petroleum industry, i.e. 31.5 feet including tool joints. However, some offshore drilling rigs use 45 foot lengths of drill pipe. Such rigs will require a shift in the transmission frequency because there is no one set of frequencies that is optimum for both 31.5 and 45 foot lengths of pipe. For 45 foot lengths, the "fundamental frequency" is 196 Hz and the frequencies for the passbands are multiples of this frequency. Assuming again that the preferred passbands fall in the 500 Hz to 1500 Hz range, then the corresponding 3, 4, 5, 6, 7 and 8th multiples of 196 Hz will define the lower end of passbands at frequencies of 588, 784, 980, 1176, 1372, and 1568 Hz respectively.

Figure 4:
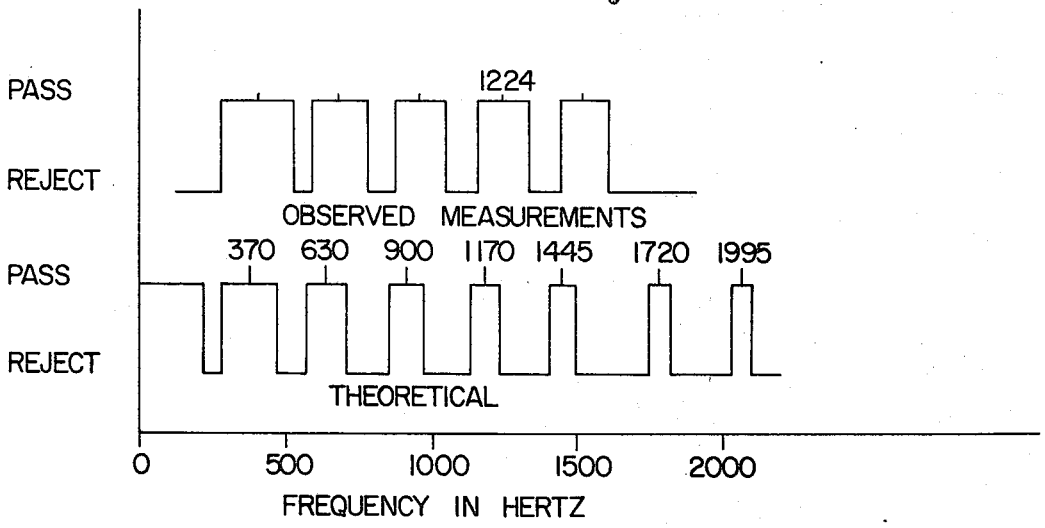

In analyzing discrepancies between the Barnes and Kirkwood theoretical analysis of drill pipe transmission passbands and measured data of the impulse tests, one discrepancy between the theoretical predictions and measured data is indicated by comparing the interval between the center frequencies of adjacent passbands. In the observed test data this interval is 270 Hz for 31.5 foot pipe, while the corresponding interval by calculation from their theoretical analysis is 310 Hz. In searching for an explanation for this difference, it was discovered that Barnes and Kirkwood used a factor of 6,000 meters per second as the velocity of sound in drill pipe. This is the commonly accepted velocity for mild steel in bulk shape (where all dimensions are approximately equal). However, it is also known that the velocity of sound in long thin rods is considerably lower (about 5200 meters per second or 17,000 ft. per second). This value for the velocity of sound was substituted in the Barnes and Kirkwood equations for compressional waves, with the results shown in FIG. 4. A comparison of the two curves in this figure reveals that the inverval between the center frequencies of the transmissions bands is now very nearly the same. However, the observed and theoretical data still disagree in that there is a large horizontal shift in the location of the center frequency of the passbands. This shift is sufficient to cause the reject bands of the theoretical data to cover close to half of the passband width of each of the observed passbands. No way was found to adjust the parameters in the Barnes and Kirkwood model to eliminate this error. This fact, in combination with observations in the field testing program led to the conclusion that the model of drill pipe behavior used in the theoretical data was fundamentally in error.

Figure 5:
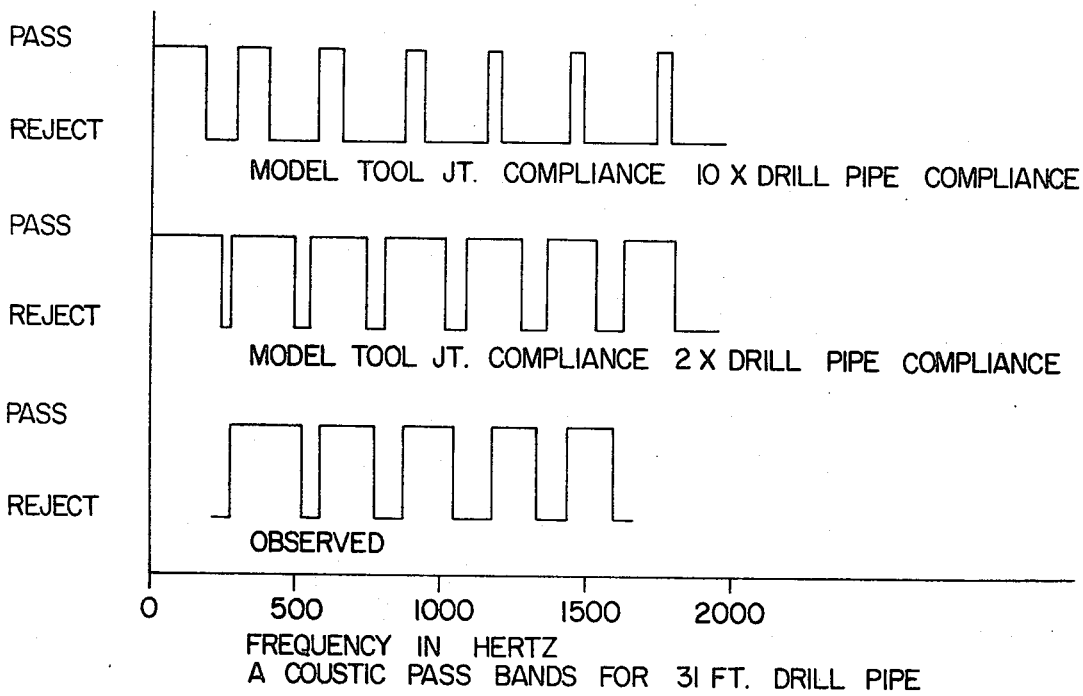

The model of the drill pipe detailed in the Barnes and Kirkwood paper consists of length of drill pipe of uniform cross-sectional area connected by tool joints of considerably larger cross-sectional area. In this model, the tool joints are much stiffer than the pipe, and it is this regularly spaced, repeating discontinuity in rigidity which would produce the pattern of transmission and rejection bands which the theoretical data predicts. While increased size and mass is the obvious difference between tool joints and pipe, there is another difference in that the tool joint contains a threaded connection. The acoustic properties of the threaded connection are very difficult to analyze but it appears that the threaded connection makes the tool joint more compliant than the drill pipe rather than stiffer. One reason for this assumption, that the thread rather than the extra metal is the controlling factor, comes from experimental observations on badly worn drill pipe. Prior to the discovery of the true location of the passbands as set forth in the procedure above, a great deal of previous experimental work was conducted at 860 Hz, which is at the lower edge of an observed passband. With pipe in good conditions, tests showed that satisfactory transmissions were frequently obtained at this frequency. However, on badly worn drill pipe the results were invariably negative. The two most noticeable effects of wear on tool joints are an appreciable reduction in the outside diameter of the joint and increased clearances in the threaded connections. The outside diameter of the tool joints, being considerably larger than the drill pipe itself, is worn by the rotation of the pipe in contact with the walls of the wellbore during a drilling operation. If the extra metal in the tool joint was a controlling factor in rejecting certain frequencies, then the selective removal of metal from the tool joints would be expected to reduce this effect and to give more nearly constant transmission at all frequencies. On the other hand, if greater compliance in the thread is the controlling factor, then thread wear would be expected to further increase compliance. This would sharpen the boundaries of passbands and increase the rejection at other frequencies. Observed data from the tests is clearly in accord with the latter explanation rather than the former. Based on these observations and in order to confirm the theory developing from the tests, a computer program was written to analyze the properties of a drill pipe string in which the joints were more compliant than the body of the pipe. There was no known way to compute the relative compliance of the tool joint and pipe, so that this was made one of the variables in the program. FIG. 5 shows a comparison of the observed dats with the computer predictions at two different compliance ratios. At a compliance ratio of 2 to 1, the size and location of the transmission bands agrees quite well with the experimental data. At a compliance ratio of 10 to 1, the transmission bands are seen to be much narrower. In fact, they are too narrow for practical telemetry with multiple repeaters. This confirms in theory the early field observations that severely worn threads would prevent transmission at frequencies near the edge of the transmission band. It is to be noted that pipe in which the threads are 10 times more compliant than the pipe body would not support itself mechanically in a drilling operation and therefore it would not be likely to encounter this extreme situation in practice.

Figure 6:
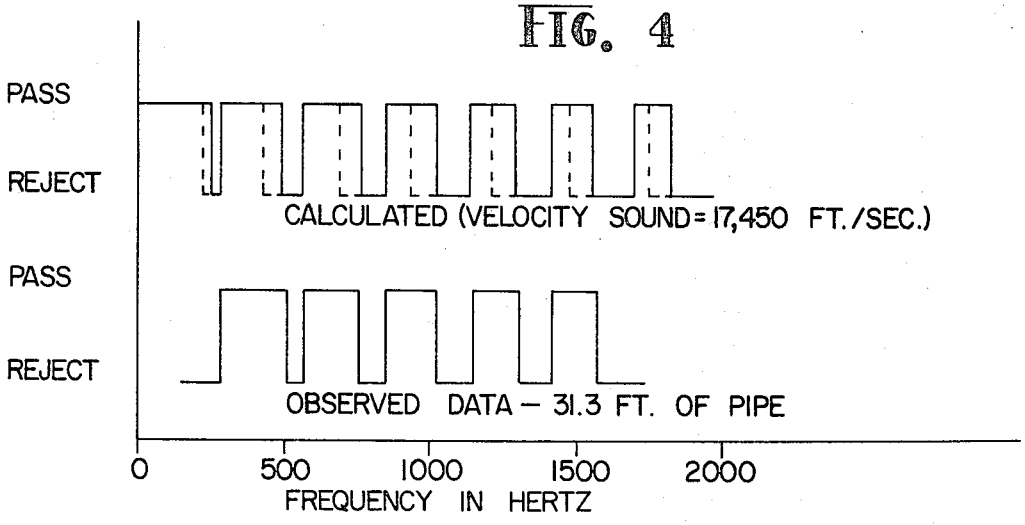
FIGS. 5, 6 and 7 are graphic representations of the effects of tool joint compliance on acoustic passbands.

It was now found that utilizing a more appropriate velocity for sound in a drill pipe, i.e. 5200 meters per second, (17000 feet per second) and considering that the threaded connection of a tool joint is more compliant than the drill pipe rather than being stiffer; then substituting these differences into the Barnes and Kirkwood mathematical formulation, data was produced which more clearly matches the theoretical data to the experimental data. This comparison is shown in FIG. 6. While it is known that the threads of the tool joints in a pipe string are more compliant than the drill pipe, there is no way to calculate how much more compliant they are. Therefore, for purposes of computer modeling a number of ratios were tried and it was found by trial and error that compliance ratio of 7 to 1 gave a band width most closely matching experimental data. As seen in FIG. 2 it can be appreciated that it is difficult to pick an exact band width from the experimental data, because the amplitude falls off gradually at both ends of each band. Therefore, there is considerable margin for error in the 7 to 1 compliance ratio, and this ratio will undoubtedly vary with age of the pipe. Threads of the pipe will increase in compliance due to wear, while the body of the pipe will not change appreciably. It should also be noted that the sound velocity used with these calculations was adjusted upward about 400 ft. per second. This was done to fine tune the calculated passbands to best fit with the measured data. This represents only a change of 2% from the handbook value of the velocity of sound in long thin rods and is in the direction of the sound velocity in bulk steel. It is not known whether this difference reflects a real difference in sound velocity in pipe as compared to thin rods or whether it indicates an error in data. A 2% error in data is quite possible in view of the multiple recording processes required to adapt measured data to the seismic data processing equipment used in analyzing the frequency array.

Figure 1:
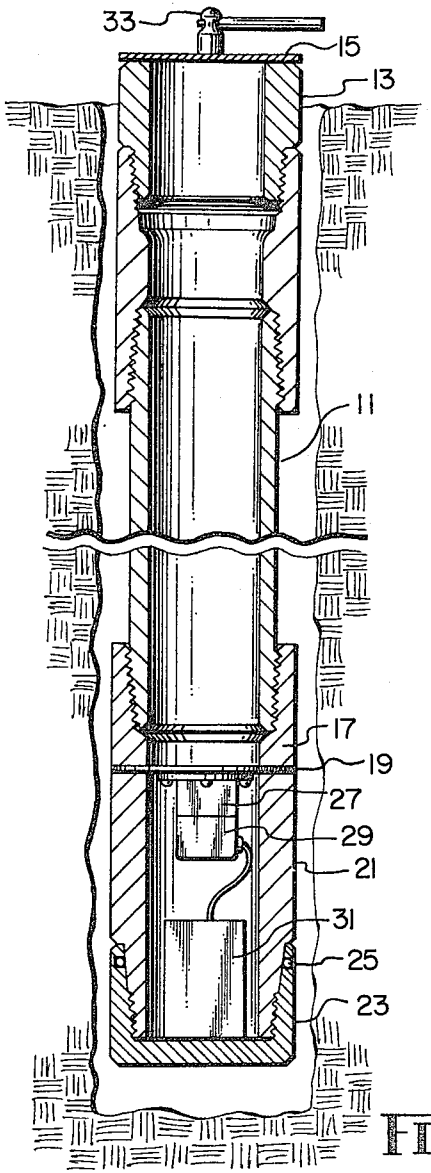
FIG. 1 is a schematic diagram of pipe string acoustic telemetry test procedure.

In working with the computer model to determined the optimum compliance ratio an interesting and surprising observation was made. As was expected, an increase in compliance ratio narrowed the passbands but the surprise came in that the change was entirely in the high end of each passband. The low end does not change at all. This is shown by comparing the dotted lines in FIG. 6 for a 20 to 1 compliance ratio with the solid line 7 to 1 curves. It turns out that the low frequency limit of each passband falls on an exact multiple of a frequency for which the length of a joint drill pipe is ½ wave length. This frequency can be calculated as follows: fundamental frequency $=17450/(2\times30.8)=283$ Hz where 17450 is the velocity of sound in feet per second and 30.8 is the length of pipe excluding thread. It will be observed that the successive passbands begin at frequencies that are 0, 1, 2, 3, 4, 5, 6, etc. times this frequency. As shown in FIG. 1 this low frequency end point does not change with the compliance ratio. Only the high frequency end shifts as the compliance ratio is changed.

Figure 7:
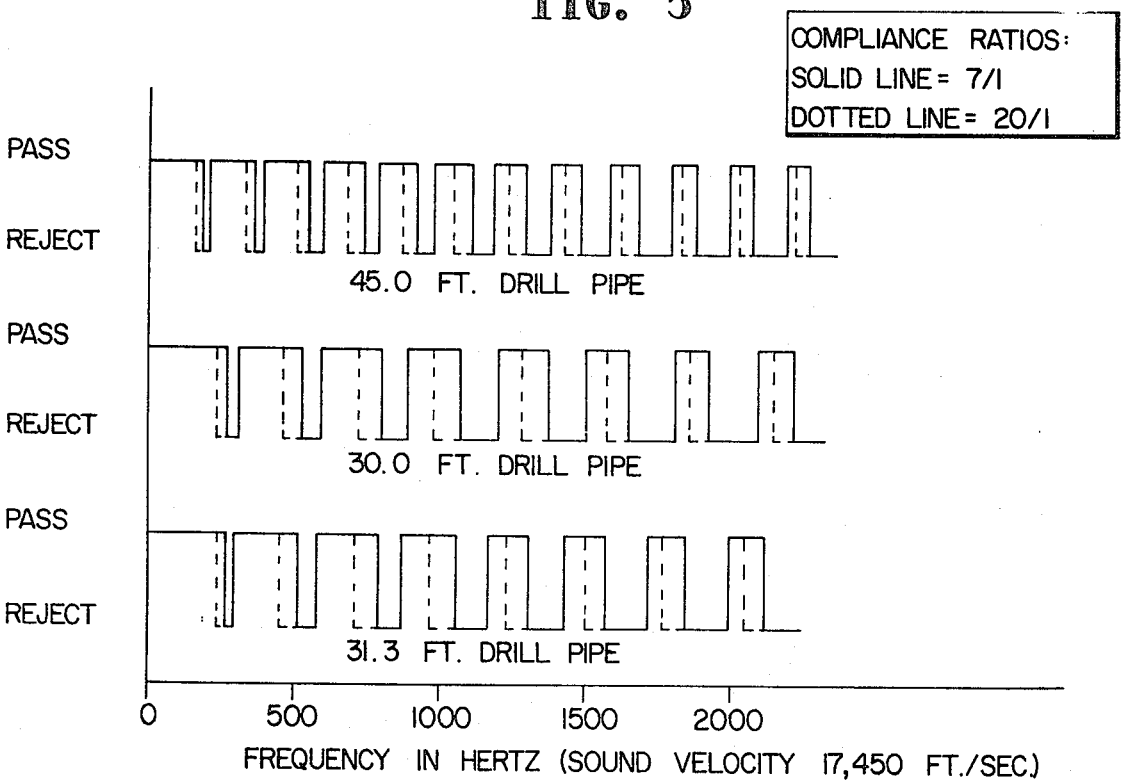

FIG. 7 shows the effect of drill pipe length on the location and width of the calculated passbands. The bottom curve is for the 31.3 foot drill pipe as in FIG. 6. The second curve for 30.0 foot drill pipe was taken as a probable lower length limit for standard drill pipe and the third curve is for 45 foot pipe which is used on some offshore rigs. It is interesting to note the location of 860 Hz on the first and second curves, in view of the erratic attenuation rates found at this frequency. For 31.3 foot pipe 860 Hz is safely within the passband, but for 30 foot pipe the lower limit of the band has moved up to 890 Hz. It may be that some of the so called bad pipe which caused severe attenuation at 860 Hz in earlier tests was really only "short" pipe.

Figure 8:
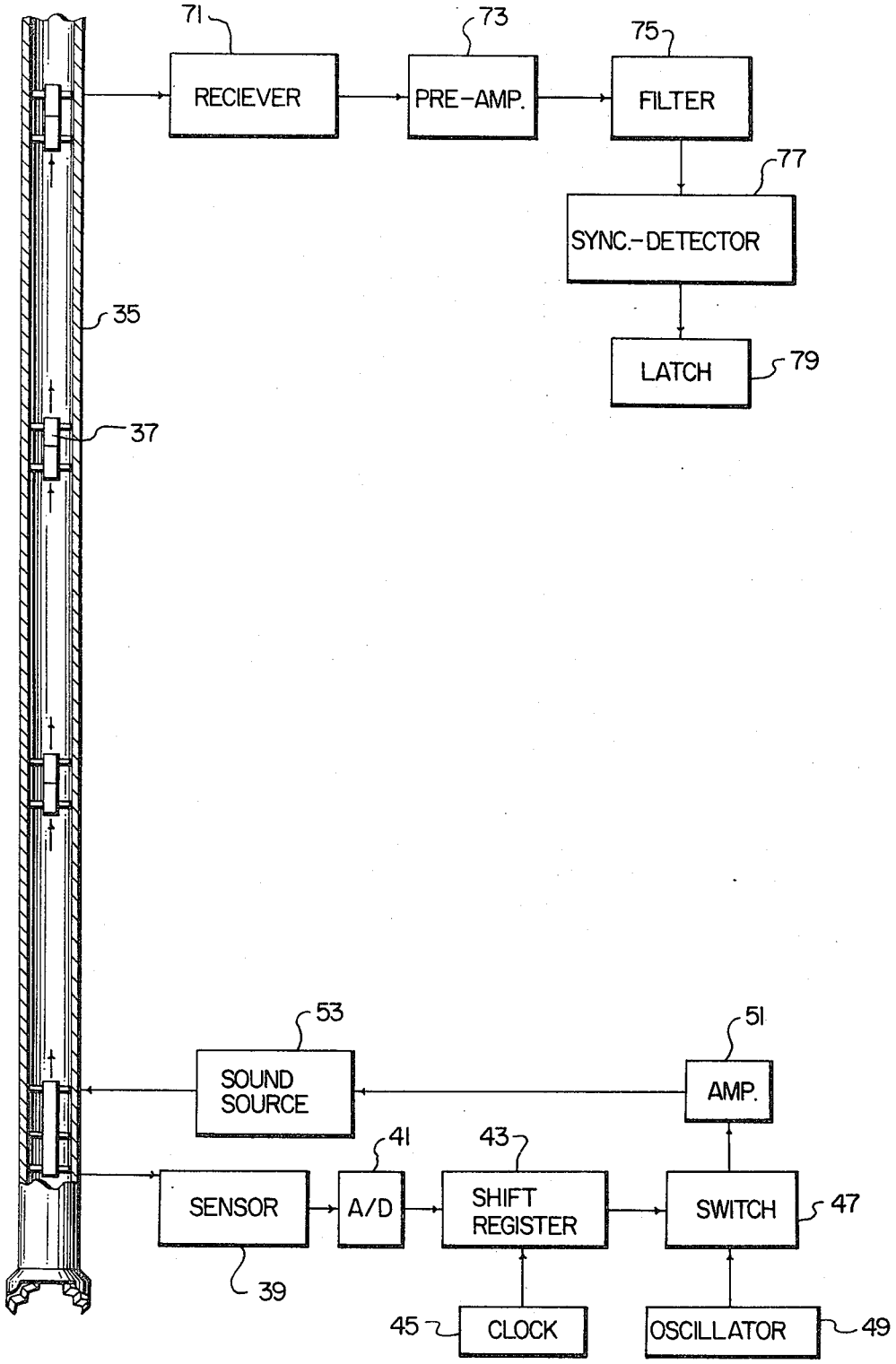
FIG. 8 is a schematic block diagram of a drill pipe telemetry system utilizing the present invention and showing bottomhole and surface electronics associated with the system.

Referring now to FIG. 8 of the drawings, a schematic diagram of a telemetry system for use with the present invention is shown. A string of drill pipe 35 is suspended in a wellbore and comprises a plurality of pipe sections (not shown) joined by theaded tool joints in a conventional manner.

A series of repeaters 37 (schematically illustrated) are installed in the pipe string at uniform intervals. The function of each repeater is in general to pick up (receive) an acoustic signal from the string of drill pipe, amplify it, and re-transmit it as an acoustic signal along the pipe.

A sensor 39 for detecting a downhole parameter, develops an analog signal which is converted to digitial coding by means of an analog to digital converter 41. An example of such a sensor is a device for determining the orientation of a borehole using a fluxgate steering tool as shown in U.S. Pat. No. 3,935,642. The signal may also be generated as pulse width data which also can be converted to digital data for transmission in the system to be described. The sensor developed signal in any event is passed into an analog to digital converter (A/D) which converts the analog voltages to a digital code utilizing "1" and "0" for all information transmission. The output of the A/D converter is fed to a shift register 43 which simply receives the now digitized signal and in conjunction with a clock mechanism 45 outputs the information to be transmitted in a timed sequence. The shift register output feeds a switch 47 which is driven by an oscillator 49 which, in turn, is operated at the desired transmission frequency falling within the passbands described above. The output of the A/D converter and shift register is either an "on" or an "off" corresponding to the digital 1 or 0 coding. If an "on" or "1" is passed from the shift register, the switch is actuated to pass the output of the oscillator to a power amplifier 51 which in turn boosts the power of the oscillator signal, which boosted signal is fed to a sound source 53. The sound source is an electromechanical device that converts the electrical energy to acoustical energy which then is imparted to the drill pipe. Such a sound source can be a fixed frequency or crystal controlled device. One type of sound device utilizes a coil which, when excited by a source of electrical energy at say 920 Hz, causes a rod within the coil to oscillate in length at 920 Hz and this motion is directed into the pipe to generate a compressional wave having a frequency of 920 Hz. Thus, the analog data which was picked up by the detector, has been converted to a binary code which in turn has been converted to an acoustic tone which is only transmitted when a "1" or "on" appears in the data. This transmission of the tone is for a fixed interval and in a clock timed sequence to permit decoding at the surface by means of a compatible clock timed decoding mechanism to be described.

One such clocking system for use with the present invention is as follows: the time allowed for each bit of data is 200 milliseconds (ms). If a "1" is transmitted, then the signal is on for 100 ms and the remaining 100 ms is for the decay of sound in the pipe. If the next digit is also a one, then the signal is passed again for 100 ms and then is off for 100 ms. If the next signal is a "0", or "off" then the signal is not passed or is quiet for 200 ms, etc. A sync signal is used to give a time reference. One such scheme allows 8 bits to a word so that the 200 ms intervals described above are repeated 8 times, then the 9th position is in the form of a parity bit. The logic is arranged so that if the "1's" in the 8 bit data stream add up to an even number, then a "1" or "on" is applied to the 9th bit. If the "1's" in the 8 bit data stream add up to an odd number, then the 9th or parity bit is a zero, i.e. no signal is passed. Thus each word in the scheme is made up of 8 bits plus a parity. The parity bit provides a means for checking for error in that if the odd-even scheme set forth above does not check out with the presence or absence of the parity bit, it is known that signals are being lost in the transmission. After 9 words (8 bits+parity) have been passed, a discrete sync signal is given such as a lapsed time frame, or a series of "1's" etc. The system thus far described utilizes a minimum of power since the sound source is only activated when a "1" data or parity bit is passed. Power is used continuously in the present system only to drive the clock mechanism and other devices which are lower power devices. Thus a system which utilizes a battery power source can be operated for a much longer period of time than one for example which transmits at a passband frequency constantly with means for modulating the signal with measured data information.

After the acoustic signal is placed on the pipe it produces a compressional wave which travels both directions on the pipe. The repeaters 37 in the pipe string are spaced to receive the acoustic signal while it is strong enough to be readily detected, thus the system of repeaters functions to detect "1's" or "on" and then retransmit a signal at a different frequency when activated by the acoustic signal which is indicative of a "1".

Also shown in FIG. 8 is a schematic disgram of surface equipment for receiving an acoustic signal emanating from a sound source either at the downhole location at the bottom of the drill string or at a repeater station 37. In either event the acoustic signal in the form of a compressional wave on the pipe is received at the surface by a signal pickup or acoustic receiver 71. The receiver 71 may be in the form of a crystal accelerometer which converts the acoustic signal to electrical energy. A preamplifier 73 increases the amplitude of the electrical signal from the receiver on the pipe for further processing at the surface. This electrical signal is further passed by hard wire or radio link to a decoder or demodulation section including a narrow band filter which passes only the frequency from the preceding sound source and is selectable to such frequency to eliminate as much noise from the signal as possible. The filter 75 passes this so-called clean data to a sync detecter circuit 77 which reconstructs the clock associated with the downhole circuitry to put the data into its word bit scheme as described with respect to downhole transmission. This clock synchronized data is now passes to a latch 79 which separates and sorts the words of data to correspond to the analog value of downhole parameters detected in the borehole which may then be read out in analog or digital form.

Figure 9:
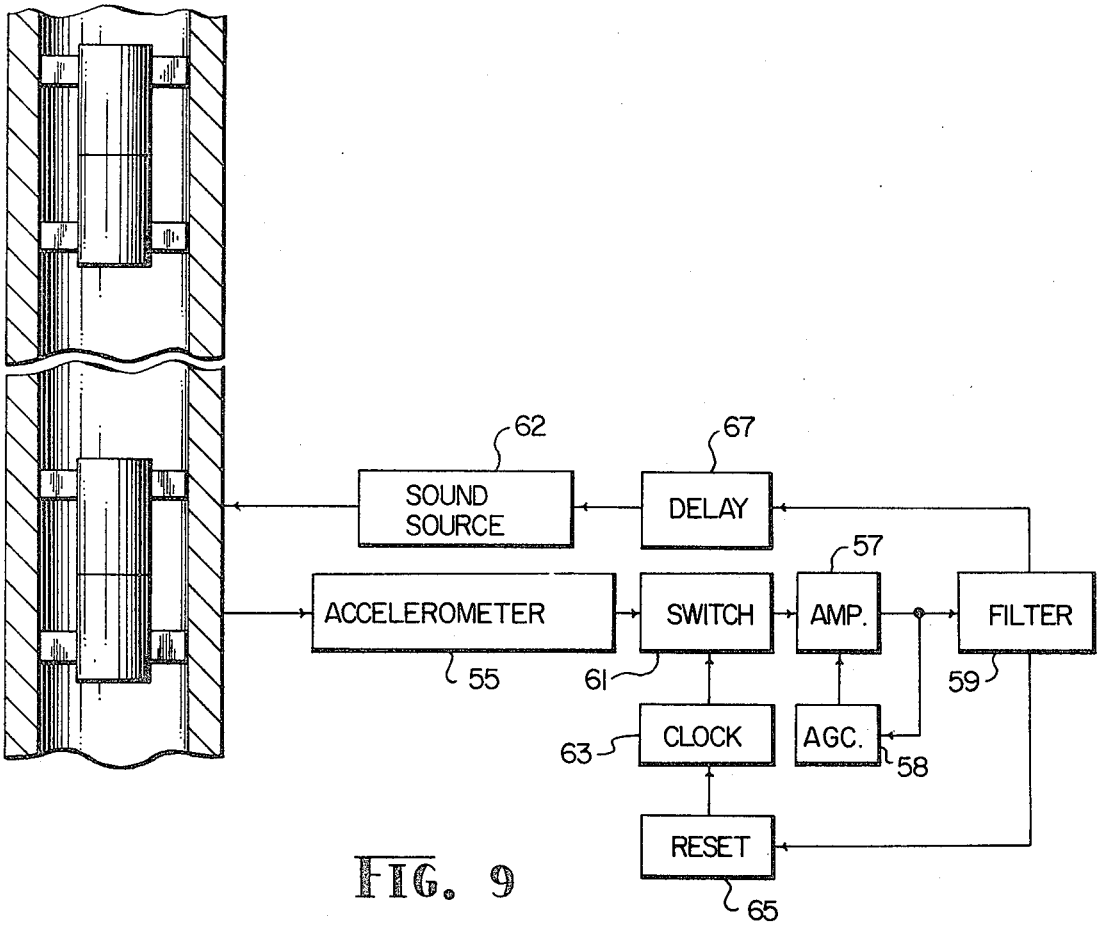
FIG. 9 is a schematic block diagram of a repeater station for use in the telemetry system of FIG. 8.

Referring next to FIG. 9, the repeater section more specifically operates as follows: a crystal accelerometer 55 coupled with the pipe picks up the signal transmitted on the pipe at a discreet frequency, i.e. 920 Hz. The accelerometer converts the acoustic signal back into an electrical signal which contains the transmitted frequency and noise on the drill pipe. The signal from the accelerometer may be as weak as 1 millivolt or as strong as several volts. In order to deal with such a wide variation of signal amplitudes, the accelerometer output is fed to an amplifier 57 having an AGC (automatic gain control) system 58 which regulates the signal passed to a narrow filter 59. The filter listens for only the fixed frequency (ex: 920 Hz) and is designed to operate over as narrow a band as possible taking into account uncontrollable variables. In the present example of 920 Hz transmitted frequency, the filter would pass say 918–922 Hz to make sure that other frequencies used in the system, i.e. 940 and 960 Hz are discriminated against in the filter. This narrow discrimination is possible with the use of a crystal controlled oscillator in the transmitter section. The filter operates most efficiently when it receives a fixed amplitude signal. The AGC 58 receives the amplifier 57 output and if it is too large, it sends a feedback signal to the amplifier which cuts down the amplifier output and vice versa. Since the repeater section also contains a transmitter section which outputs a 30 volt signal, this strong signal would activate the AGC circuit to cut down the amplifier gain too much for effective amplification of data signals. Therefore, an electronic switch 61 is placed in the circuit to cut out the amplifier and AGC control when the instant repeater sound source 62 is transmitting and is open the rest of the time to listen for the next bit of data. Each data bit received operates a reset 65 which resets a clock 63 to gate this switch device to clamp input so as to not listen to the retransmitted pulse. This clamp stays on for a sufficient time to prevent ringing of the sound source from disturbing the receiver.

The repeater filter thus outputs a pure 920 Hz signal which is only present when a transmission ("1" or "on") is received and absent at all other times. The filter output is passed to a delay section 67 which delays the repeater transmitter until the receiver is off, thus phase shifting the transmission with respect to reception. In the example system the repeater transmitter operates at 940 Hz.

Figure 10:
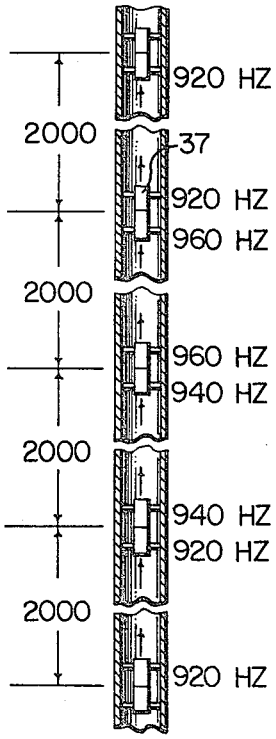
FIG. 10 is a schematic diagram illustrating the use of multiple repeater stations and frequency mix for use in the telemetry system of FIGS. 8 and 9.

Additional repeater sections are utilized in the system depending on depth. For example, if the depth of drilling, age of pipe, etc. dictates a telemetry system utilizing more than one repeater section, subsequent sections may be operated at 940 Hz and 960 Hz, alternating between the various frequencies as shown schematically in FIG. 10. In this example, with a spacing of 2000 feet between repeaters 37 and utilizing three frequencies, a total of 8000 feet exists between transmitters operating at the same frequency, which provides sufficient attentuation of signal to prevent any stray signals from same frequency stations from being confused as current data signals. In any event, distance between repeaters and frequency mix will be determined by signal loss and receiver signal lock on capability. The acoustic signal transmitted by each acoustic transmitter (sound source) does of course travel in both directions along the pipe thus the transmitter which develops a 920 Hz signal near the surface in FIG. 10 sends the signal downwardly as well as upwardly (the latter being the desired direction in the instance of sending data from subsurface to surface). However, the staggered-frequency arrangement described, wherein there are three different frequencies used by three different repeaters and wherein these repeaters are spaced in the drill string, discriminates in favor of the upward direction of travel of the acoustic signal.

While for the most part, the invention herein has been described as being a telemetry system for detecting downhole data for transmission to the surface, it is readily seen that the system is equally applicable for sending data, control signals or the like from the surface to downhole such as to perform a downhole operation by surface control.

Therefore, while particular embodiments of this invention have been shown and described, it is to be understood that further modifications may now suggest themselves to those skilled in the art and it is intended to cover such modifications as fall within the scope of the appended claims.

We claim:

1. A telemetry system for transmitting acoustical signals over a string of standard drill pipe positioned in a borehole and having pipe sections of approximately 31.3 feet including:

acoustical transmitting and receiving means occurring at first and second spaced locations on the string of pipe; and means for operating said transmitting means at a frequency above 600 Hz and occurring within passbands having a frequency band width of 130 Hz and base frequencies which are 20 Hz above integral multiples of 283 Hz.

2. The system of claim 1 wherein the system includes:

downhole means for detecting a borehole parameter;

means for generating an electrical signal which is indicative of the detected parameter; and further wherein said transmitting means includes means responsive to the generated electrical signal for imparting acoustical signals to the string of pipe at at least one frequency falling within said passbands.

3. The apparatus of claim 2 wherein said receiving means includes:

surface means for receiving said acoustical signals; and means responsive to the received acoustical signals for generating electrical signals which are indicative of the detected parameter.

4. The apparatus of claim 3 and further including:

repeater means positioned on said string of pipe between the downhole means and surface means, said repeater means having a receiver for receiving the acoustical signals and acoustical signal generating means responsive to the receiver for generating acoustical signals of a different frequency within a passband.

5. The system of claim 1 and further including:

repeater means positioned on the string of pipe between the first and second spaced locations, said repeater means having a receiving section for receiving said acoustical signal of a first frequency and acoustical signal generating means operative in response to said receiving section receiving said acoustical signal of the first frequency for generating an acoustical signal of a second frequency, said first and second frequencies occurring within different ones of said passbands.

6. The telemetry system of claim 5 wherein said acoustical transmitting and receiving means includes transducer interface means at said first and second spaced locations for transforming electrical signals into acoustical signals and for transforming acoustical signals into electrical signals.

7. A telemetry system for transmitting an acoustical signal over a string of drill pipe made up of sections of pipe of approximately equal length and positioned in a borehole, including:

acoustical signal transmitting and receiving means positioned at first and second spaced locations on the string of pipe; and means for operating said transmitting means at a fixed frequency occurring within frequency passbands above 600 Hz which have a lower limit that is an integral multiple of a frequency approximated by a ratio of 17,450 to twice the length of a pipe section.

8. The system of claim 7 and further including repeater means positioned on said string of pipe between said first and second spaced locations and having receiving and transmitting means therein for receiving said fixed frequency and in response thereto transmitting an acoustical signal of a second fixed frequency within said frequency passbands.

9. The system of claim 8 and further including a second repeater means for receiving said second fixed frequency and in response thereto transmitting a third fixed frequency within said frequency passbands.

10. The system of claim 7 wherein said first and second spaced locations are located on the pipe string at the bottom and at the surface of a borehole respectively and further including downhole means for detecting a physical parameter in said borehole, means for providing an electrical signal indicative of said borehole parameter and means responsive to said electrical signal for operating said transmitting means.

11. The system of claim 10 wherein said acoustical receiving means includes surface means for detecting the fixed frequency acoustical signal; and means operable in response to said detecting means for providing an electrical signal indicative of the detected borehole parameter.

12. The system of claim 11 and further including repeater means positioned in the pipe string for receiving the acoustical signal of a fixed frequency and in response to the reception thereof, transmitting another acoustical signal at another fixed frequency selected from said passbands.

13. The system of claim 10 wherein said detecting means produces an analog signal indicative of a detected parameter and further including means for converting said analog signal to a digital pulse code, and wherein said transmitting means includes means for operating an acoustical sound source in a clock related sequence with the digital pulse to provide a fixed frequency acoustical pulse code indicative of the detected parameter.

14. The system of claim 13 wherein said receiving means includes transducer means at the surface for receiving said acoustical pulse and providing a surface electrical signal in response thereto; and further including means for synchronously relating the surface electrical signal to the clock related downhole pulse to provide a signal at the surface which is indicative of the downhole detected parameter.

15. A telemetry system for transmitting acoustical signals over a string of drill pipe having pipe sections of approximately 44.5 feet, including:

acoustical transmitting and receiving means occurring at first and second spaced locations on the string of pipe; and means for operating said transmitting means at a frequency above 600 Hz and occurring within frequency passbands having a frequency band width of 100 Hz and base frequencies which are 20 Hz above integral multiples of 196 Hz.

16. The system of claim 15 wherein the system includes downhole means for detecting a borehole parameter, means for generating an electrical signal indicative of the detected parameter, and further wherein said transmitting means is responsive to the generated electrical signal for imparting an acoustical signal to the string of pipe at a frequency falling within said passbands.

17. The apparatus of claim 16 wherein said receiving means includes surface means for receiving said acoustical signal, and means responsive to the received acoustical signal for generating an electrical signal which is indicative of the detected parameter.

18. The apparatus of claim 17 and further including repeater means positioned on said string of pipe between the downhole means and surface means, said repeater means having a receiver for receiving the acoustical signal and acoustical signal generating means responsive to the receiver for generating an acoustical signal of a different frequency within a passband.

19. The system of claim 15 and further including repeater means positioned on the string of pipe between the first and second spaced locations, said repeater means having a receiving section for receiving said fixed frequency acoustical signal of a first fixed frequency and acoustical signal generating means operative in response to said receiving section receiving said fixed frequency acoustical signal of the first fixed frequency for generating an acoustical signal of a second fixed frequency, said first and second fixed frequencies occurring within different ones of said passbands.

20. The telemetry system of claim 19 wherein said acoustical transmitting and receiving means includes transducer interface means at said first and second spaced locations for transforming between electrical signals and acoustical signals.

21. A method for acoustically transmitting signals over an elongated member made up of individual sections of approximately equal length in a borehole and having transmitting and receiving devices acoustically coupled with the elongated member, comprising the steps of:

generating a fixed frequency acoustical signal at one position on said elongated member at a discrete frequency above 600 Hz and which occurs within frequency passbands which have a lower limit that is an integral multiple of a frequency for which one elongated member section length is approximately a half wave length;

imparting the acoustical signal to the elongated member; and receiving said discrete frequency acoustical signal at a spaced location on said elongated member.

22. The method of claim 21 and further including generating an electrical signal at said spaced location which electrical signal is indicative of the received discrete frequency acoustical signal.

23. The method of claim 21 and further including detecting a borehole parameter at said one position on the elongated member, generating an electrical signal which is indicative of the detected parameter, and operating said transmitting device in response to the generated electrical signal to provide said discrete frequency acoustical signal.

24. The method of claim 21 and further including the steps of:

detecting a borehole parameter at the one position;

generating an electrical signal indicative of a detected parameter;

operating the transmitting device in response to the electrical signal to provide said discrete frequency acoustical signal which is received at the spaced location on said elongated member;

generating an electrical signal in response to a received discrete frequency acoustical signal which electrical signal is indicative of the detected borehole parameter.

25. The method of claim 24 wherein the generated electrical signal indicative of a detected parameter at the one position is an analog signal; and further including converting the analog signal to a digital pulse code, and operating the transmitting device in response to the digital pulse code.

26. A method for acoustically transmitting data over a string of drill pipe comprised of pipe sections of approximately equal length suspended in a borehole and having transmitting and receiving devices coupled with the pipe string at first and second spaced locations, comprising the steps of:

generating a fixed frequency electrical signal at one of the spaced locations which fixed frequency electrical signal is indicative of data to be transmitted over the string of pipe;

operating an acoustical signal generating device in response to the generated electrical signal at a discrete acoustical frequency above 600 Hz and which occurs within frequency passbands each having a lower limit that is an integral multiple of a frequency for which one pipe section length is approximately a half wave length;

passing the discrete acoustical signal over the string of pipe to the other of the spaced locations;

detecting the passed acoustical signal at said other spaced location; and generating an electrical signal at said other spaced location in response to the detected acoustical signal which is indicative of the transmitted data.

27. The method of claim 26 and further including generating said acoustical signal in passbands having a frequency width of 130 Hz and base frequencies which are 20 Hz above integral multiples of 283 Hz.

28. The method of claim 26 and further including receiving said passed discrete acoustical signal at an intermediate position between the first and second spaced locations on the string of pipe;

operating a repeater transmitter at a second discrete acoustical frequency occurring within said frequency passbands in response to the received discrete acoustical signal; and receiving said second discrete acoustical signal at the other of the spaced locations.

29. A method of acoustically transmitting data through a drill pipe of about 30.8 feet in length in a borehole comprising the steps of:

generating in the drill pipe acoustic vibrations having frequencies above 600 Hz in a 150 Hz passband and base frequencies which are 20 Hz above integral multiples of 283 Hz;

coding said acoustic vibrations in the drill pipe with data to thereby transmit the data over the drill pipe;

receiving said data coded acoustic vibration from the drill pipe at a location spaced from the point of vibration generating thereon; and separating coded data from the acoustic vibrations.

30. A method of acoustically transmitting data through a drill pipe of about 45 feet in length in a borehole comprising the steps of:

generating in the drill pipe acoustic vibrations having frequencies above 600 Hz in a 100 Hz passband and base frequencies which are 20 Hz above integral multiples of 196 Hz;

coding said acoustic vibrations in the drill pipe with data to thereby transmit the data over the drill pipe;

receiving said data coded acoustic vibration from the drill pipe at a location spaced from the point of vibration generating thereon; and separating coded data from the acoustic vibrations.

31. The method of claim 26 and further including generating such acoustical signal in passbands having a frequency width of 100 Hz and base frequencies which are 20 Hz above integral multiples of 196 Hz.

32. The method of claim 21, wherein a lower limit frequency for determining the passbands is an integral multiple of a frequency approximately by a ratio of 17,450 to twice the length of a pipe section.

33. The method of claim 32 wherein the passband has a band width of 130 Hz and base frequencies which are 20 Hz above the lower limit frequency.

* * * * *